US007053793B2

(12) United States Patent
Tajima et al.

(10) Patent No.: US 7,053,793 B2
(45) Date of Patent: May 30, 2006

(54) SYSTEM FOR NOTIFYING TOLL CHARGE INFORMATION

(75) Inventors: Koji Tajima, Tokyo (JP); Naoki Matsumoto, Tokyo (JP); Hiroaki Ban, Tokyo (JP); Kazuhiro Yamada, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 0 days.

(21) Appl. No.: 10/788,031

(22) Filed: Feb. 25, 2004

(65) Prior Publication Data

US 2004/0212518 A1 Oct. 28, 2004

(30) Foreign Application Priority Data

Feb. 26, 2003 (JP) ..... 2003-049941

(51) Int. Cl.
*G08G 1/00* (2006.01)

(52) U.S. Cl. ..... 340/928; 340/933; 235/384; 455/406; 701/201; 705/13

(58) Field of Classification Search ..... 340/928, 340/932.2, 933, 988, 955.13, 995.17; 235/375, 235/382, 383, 382.5, 384, 380, 385; 705/13, 705/40; 455/403, 406, 408; 701/1, 200, 701/201, 213
See application file for complete search history.

(56) References Cited

U.S. PATENT DOCUMENTS

| | | | | |
|---|---|---|---|---|
| 4,303,904 | A | 12/1981 | Chasek | |
| 5,490,079 | A | 2/1996 | Sharpe et al. | |
| 5,640,156 | A * | 6/1997 | Okuda et al. | 340/928 |
| 5,819,234 | A | 10/1998 | Slavin et al. | |
| 5,955,970 | A * | 9/1999 | Ando et al. | 340/928 |
| 6,233,519 | B1 | 5/2001 | Yamada | |
| 6,658,392 | B1 * | 12/2003 | Yoshida | 705/13 |
| 6,816,707 | B1 * | 11/2004 | Barker et al. | 455/41.2 |
| 2002/0067291 | A1 | 6/2002 | Ikeda | |

FOREIGN PATENT DOCUMENTS

| | | |
|---|---|---|
| DE | 43 44 433 A1 | 7/1995 |
| EP | 1 197 924 A1 | 4/2002 |
| EP | 1 278 163 A1 | 1/2003 |
| JP | 2001-250137 | 9/2001 |
| WO | WO 99/33027 | 7/1999 |

* cited by examiner

*Primary Examiner*—Davetta W. Goins
(74) *Attorney, Agent, or Firm*—Brinks Hofer Gilson & Lione

(57) ABSTRACT

When car navigation device 100 detects that a vehicle has passed a toll gate, car navigation device 100 outputs a toll gate passage signal. When mobile communication terminal 200 receives the toll gate passage signal, mobile communication terminal 200 accesses from charge server 400 an entity of electronic toll collection system, the latest information on the balance in the prepaid account of the customer.

21 Claims, 7 Drawing Sheets

FIG. 3

| TOLL GATE ID | LOCATION | 1: ENTRANCE / 2: EXIT |
|---|---|---|
| 0001 | 130° EAST LONGITUDE / 45° NORTH LATITUDE | 1 |
| 0002 | 131° EAST LONGITUDE / 44° NORTH LATITUDE | 2 |
| 0003 | ••• | ••• |

FIG. 4

| ENTRANCE ID | ENTRANCE NAMES | EXIT ID | EXIT NAMES | DATE AND TIME WHEN A VEHICLE PASSES A TOLL GATE | TOLL CHARGE | INFORMATION ON BALANCE ON A PREPAID |
|---|---|---|---|---|---|---|
| 0001 | A | 0002 | B | 02/12/12 | ¥800 | ¥2500 |
| ••• | ••• | ••• | ••• | ••• | ••• | ••• |
| ••• | ••• | ••• | ••• | ••• | ••• | ••• |

| | | EXIT | | | |
|---|---|---|---|---|---|
| | | TOLL GATE A | TOLL GATE B | TOLL GATE C | TOLL GATE D |
| ENTRANCE | TOLL GATE A | | 600 | 800 | 1000 |
| | TOLL GATE B | 600 | | 1200 | 1200 |
| | TOLL GATE C | 800 | 1200 | | 1600 |
| | TOLL GATE D | 1000 | 1200 | 1600 | |

FIG. 7

| USER ID | AN ENTRANCE ID | A NAME OF THE ENTRANCE TOLL GATE | AN EXIT ID | A NAME OF THE EXIT TOLL GATE | DATE AND TIME OF TOLL GATE PASSAGE | TOLL CHARGE | INFORMATION ON THE BALANCE IN A PREPAID ACCOUNT |
|---|---|---|---|---|---|---|---|
| 1001 | 0001 | A | 0002 | B | 02/12/12 | ¥800 | ¥2500 |
| 1002 | . . . | . . . | . . . | . . . | . . . | . . . | . . . |
| 1003 | . . . | . . . | . . . | . . . | . . . | . . . | . . . |

SYSTEM FOR NOTIFYING TOLL CHARGE INFORMATION

TECHNICAL FIELD

The present invention relates to a system for notifying a customer of toll charge information. In particular, the present invention relates to a notification of toll charge information stored in an automatic charge system which automatically charges a toll charge for a vehicle when the vehicle passes a toll gate.

RELATED ART

Electronic Toll Collection System (hereinafter referred to as "ETC"), which enables charging a passage at a toll gate of a toll road without stopping a vehicle, is already in use. Options of payment for ETC include later payment, and advance payment. Later payment can be made using a method similar to that of paying by conventional credit cards. In the case of later payment, charges stored in a charge server are accumulated every month and the accumulated charge is directly debited to the customer's bank account. In the case of advance payment, on the other hand, a predetermined amount of money is prepaid into an account, and each time a customer uses a toll road the toll charge is subtracted from the prepaid account. The mode of advance payment has an advantage in that a customer earns special bonus points on a predetermined amount of money prepaid into an account. In a case, when the balance in a customer's prepaid account is not sufficient to pay an incurred charge, the payment mode switches from that of prepaid to that of credit or the mode of later payment. However, the disadvantage in this is that the customer loses bonus points on having to pay by default through the later payment mode.

One of the solutions for the above-mentioned problem is to provide a means for a customer of checking the balance in the prepaid account so that the customer can maintain sufficient balance in the prepaid account to pay all subsequent toll charges. The following two methods are used for confirming the balance in the prepaid account: (1) through online accessing of the prepaid account; and (2) by making a telephone call to the concerned authority. However, both these methods are inconvenient because the customer must operate his/her communication terminal in order to access the necessary information. Furthermore, in order for a customer to access the latest information on a prepaid account such as just after passing a toll gate, it is both inconvenient as well as unsafe to operate a communication terminal as the customer's vehicle would still be in motion and the customer would have to come to a halt before performing the necessary operation. Also, there is a certain time lag between the time of passing a toll gate and the time of confirming the balance in the prepaid account. In a case that the customer does not confirm the balance in the prepaid account because of insufficiency of time after passing a toll gate and before reaching another toll gate, there is a possibility that the customer may pass a toll gate without adequate balance in the prepaid account to pay the latest toll charge. In such a case, the customer cannot get the benefit of bonus points on the prepaid account.

In order to overcome this problem, a system which enables a customer to access the latest information on a prepaid account without operating his/her communication terminal, is suggested (for example, as disclosed in JP 2001-250137A, a Japanese Patent Application Laid-Open Publication). According to the system, a car-mounted ETC device receives gate passage information when the car passes a toll gate, and the gate passage information is transmitted to a car navigation device connected to the ETC device. When the car navigation device receives the gate passage information, the car navigation device compares the present location with map information, identifies the toll gate, and stores the name of the toll gate. When the toll gate is an exit, the car navigation device establishes a connection with a website of the ETC provider via the communication terminal connected to the car navigation device. Then, the car navigation device searches toll charge information by using user identification number (user ID) and the toll gate information, and displays the search results on the display of the car navigation device.

In most ETC systems, an IC card, which is used by being inserted into a car-mounted ETC device, stores personal information of the customer. Therefore, it is not recommended that the car-mounted ETC device be connected to another electronic device which is capable of communicating with other electronic devices or communication networks, as personal information on the customer can be transmitted to a public network. In the prior art, if a car-mounted ETC device is not connected to a car navigation device, the car navigation device cannot receive gate passage information. Therefore, it is impossible for the car navigation device to identify the name of the toll gate and to search toll charge information. As a result, the customer cannot confirm the balance in the prepaid account immediately after passing a toll gate.

SUMMARY OF THE INVENTION

The present invention provides a solution to the above problem. In other words, the present invention allows the customer to confirm the balance in the prepaid account immediately after the car passes a toll gate without operating any terminal devices, independent of the connection between a terminal device that is mounted on a vehicle and is an entity of an ETC system and another terminal device that is not an entity of an ETC system.

To solve the problem, the present invention provides a system for notifying charge information having a plurality of toll gate and a charge apparatus for storing information on the balance in a prepaid account of a customer or a vehicle, and for subtracting a toll charge from the balance in the prepaid account when the vehicle passes a toll gate, comprising: a location measurement device that outputs a toll gate passage signal when the location measurement device detects that the vehicle has passed a toll gate on the basis of a toll gate passage detection rule using a location relation information of the vehicle and the toll gate, the location measurement device being carried by or mounted on the vehicle; and a mobile communication terminal that accesses from the charge apparatus, latest information on the balance in a prepaid account when the mobile communication terminal receives the toll gate passage signal, the mobile communication terminal being carried by or mounted on the vehicle.

The location identification device outputs a toll gate passage signal when the location identification device detects that the vehicle has passed a toll gate. When the mobile communication terminal receives the toll gate passage signal, the mobile communication terminal accesses latest information on the balance in the prepaid account of the customer from the charge device, which is the procedure that constitutes the electronic toll collection system.

In one embodiment of the present invention, the charge apparatus may store information on the balance in the prepaid account correspondingly to an identifier of the customer or an identifier of the vehicle. The mobile communication terminal may transmit to the charge apparatus the identifier of the vehicle or the identifier of the customer when the mobile communication terminal accesses from the charge apparatus latest information on the balance in the prepaid account.

In another embodiment, the charge apparatus may store information on the balance in the prepaid account correspondingly to an identifier of the toll gate which the vehicle passed. The location measurement device may store the identifier of the toll gate and makes the toll gate passage signal to include the identifier of the toll gate. The mobile communication terminal may transmit the toll gate passage signal including the identifier of the toll gate when the mobile communication terminal accesses from the charge apparatus latest information on the balance in the prepaid account.

In another embodiment, the toll gate passage detection rule may determine that the vehicle has passed the toll gate on the basis of a variation in the location relation of the vehicle and the toll gate.

In another embodiment, the toll gate passage detection rule may determine that the vehicle has passed the toll gate when a distance between a toll gate and the vehicle falls below a predetermined value and subsequently exceeds the predetermined value.

In another embodiment, the toll gate may be a toll gate of a toll road. The location measurement device may store map data showing a road map. The location measurement device may identify a first toll gate that the vehicle can pass on the basis of the map data, the location of the vehicle, and the location of the toll gate. The location measurement device may output a toll gate passage signal showing that the vehicle has passed the toll gate when the location measurement device detects that the vehicle has passed the toll gate.

The present invention also provides a car navigation device, comprising: storage means for storing map data showing road maps; detection means for detecting that a vehicle has passed a toll gate on the basis of a toll gate passage detection rule using a present location of the vehicle and a location of the toll gate, the car navigation device being carried by or mounted on the vehicle, the location of the toll gate being stored in the storage means; generating means for generating a toll gate passage signal when the detection means detects that the vehicle has passed the toll gate, the toll gate passage signal showing that the vehicle has passed the toll gate; and output means for outputting the toll gate passage signal.

In one embodiment, the car navigation device may further comprise receiving means for receiving data showing information on the balance in a prepaid account of a customer or the vehicle, from a communication terminal.

In another embodiment, the toll gate passage detection rule may determine that the vehicle has passed the toll gate on the basis of a variation history in the location relation of the vehicle and the toll gate.

BRIEF DESCRIPTION OF THE DRAWINGS

Preferred embodiments of the present invention will be described in detail based on the following figures, wherein:

FIG. 3 illustrates the contents of the toll gate database stored in the storage unit of the car navigation device;

FIG. 4 illustrates the contents of the usage history database stored in the storage unit of the car navigation device;

FIG. 7 illustrates the contents of the charge database stored in the storage unit of the charge server;

BEST MODE FOR CARRYING OUT THE INVENTION

The preferred embodiments of the present invention will be described in detail with reference to the above-described figures.

<1. Configuration>

<1-1. Configuration of the System>

Figure 1:
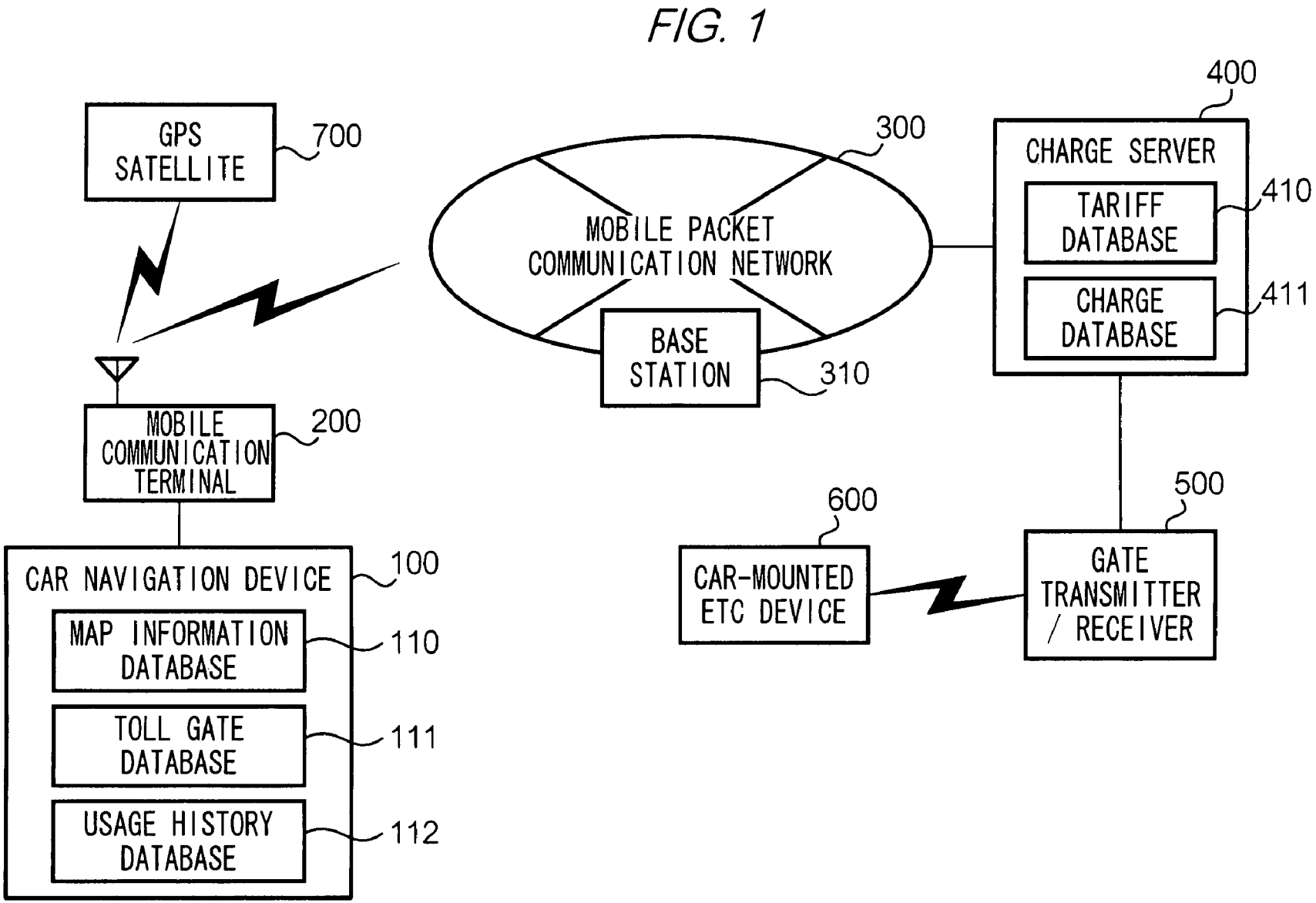
FIG. 1 is a block diagram showing the configuration of a system of one embodiment in accordance with the present invention.

FIG. 1 is a block diagram showing the configuration of a system of one embodiment in accordance with the present invention. As shown in FIG. 1, the system comprises car navigation device 100 (location identification device), mobile communication terminal 200 (mobile communication device), wireless base station 310, mobile packet communication network 300, charge server 400, toll gate transmitter/receiver 500, car-mounted ETC device 600, and GPS (Global Positioning System) satellite 700. Car navigation device 100 and car-mounted ETC device 600 are mounted on a car. Car navigation device 100 and car-mounted ETC device 600 are not connected to each other, and thus car navigation device 100 and car-mounted ETC device 600 cannot communicate with each other. Mobile communication terminal 200 is capable of communicating with car navigation device 100 by wired connection or wireless communication complying with a standard such as Bluetooth. Toll gate transmitter/receiver 500 is connected to charge server 400 which is administered by the ECT administrator. Also, toll gate transmitter/receiver 500 is capable of communicating with car-mounted ETC device 600 by wireless system. Mobile communication terminal 200 is capable of communicating with charge server 400 administered by the ETC administrator via mobile packet communication network 300. In FIG. 1, although only a single number of each of the elements is described, it is possible that a plurality of numbers of the elements described in FIG. 1 be configured to work together.

<1-2. Configuration of Car Navigation Device and Mobile Communication Terminal>

Figure 2:
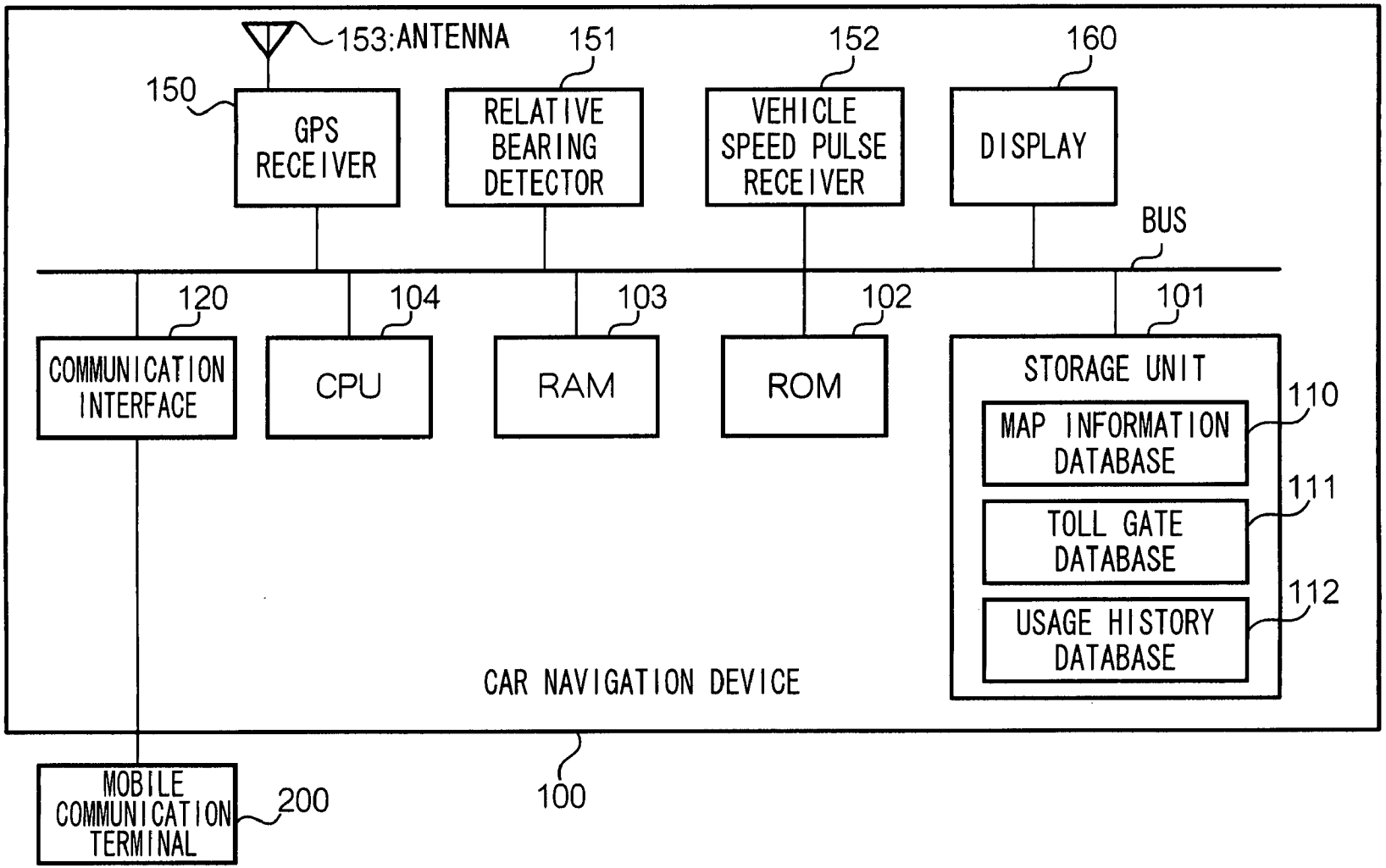
FIG. 2 is a block diagram showing the configuration of a car navigation device in accordance with the embodiment.

FIG. 2 is a block diagram showing the configuration of car navigation device 100 in accordance with the present embodiment. ROM (Read Only Memory) 102 stores a variety of programs. CPU (Central Processing Unit) 104 executes these programs by using RAM (Random Access Memory) 103 as work area. Storage unit 101 is a nonvolatile memory such as a HDD (Hard Disk Drive) for storing map information database 110, toll gate database 111 of toll roads, and usage history database 112.

FIG. 3 illustrates the contents of toll gate database 111. As shown in FIG. 3, toll gate database 111 stores identification information on toll gates (toll gate ID), location information on toll gates, and information for identifying whether a toll gate is an entrance or an exit. FIG. 4 illustrates the contents of usage history database 112. As shown in FIG. 4, usage history database 112 stores entrance IDs, entrance names, exit IDs, exit names, sets of date and time when a vehicle passes a toll gate, toll charges, and information on balance on a prepaid account. GPS transmitter/receiver 150 transmits a signal for enquiring its own location information to GPS satellite 700 at regular intervals via antenna 153. GPS transmitter/receiver 150 receives location information transmitted in response to the enquiry. Relative bearing detector 151 is a gyroscope for measuring a relative bearing of the vehicle. Vehicle speed pulse receiver 152 receives vehicle speed pulse from the vehicle. CPU 104 calculates the location of the vehicle on the basis of the location information, the relative bearing, and the vehicle speed pulse of the vehicle. Communication interface 120 is an interface for communicating with mobile communication terminal 200 by wired or wireless communication.

Figures 5, 6:
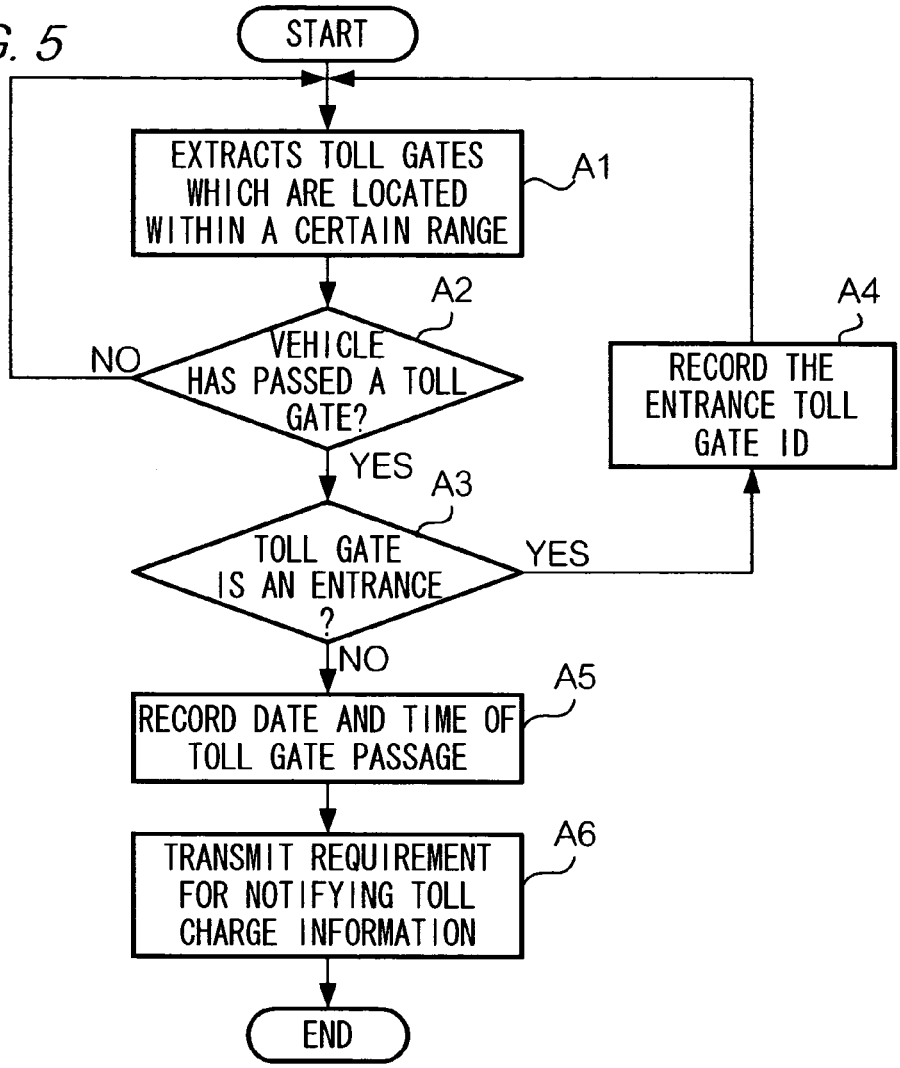
FIG. 5 is a flowchart illustrating an operation of a toll gate passage detection program executed by CPU.
FIG. 6 illustrates the contents of the tariff database stored in the storage unit of a charge server in accordance with the embodiment.

After car navigation device 100 is turned on, CPU 104 initiates the toll gate passage detection program immediately. FIG. 5 is a flowchart illustrating an operation of the toll gate passage detection program executed by CPU 104. The operation is as follows. First, CPU 104 extracts toll gates which are located within a certain range (for example, 5 kilometer radius) from the current location of the vehicle, from toll gate database 111 (step A1). Then, CPU 104 calculates the distances between the locations of each of the extracted toll gates and that of the vehicle. Finally, CPU 104 determines whether a distance between a toll gate and the vehicle falls below a predetermined value (for example, 1 meter) and subsequently exceeds the predetermined value, for each of the extracted toll gates. CPU 104 repeats these steps at regular intervals. According to the determination, a toll gate which the vehicle has just passed is identified. Thus, it can be detected that the vehicle has passed a toll gate (step A2). After it is detected that a toll gate has been passed, CPU 104 determines that the toll gate is an entrance or an exit by referring to toll gate database 111 (step A3). If the toll gate is an entrance, the toll gate ID of the toll gate is recorded at an entrance ID field in usage history database 112 (step A4). If the toll gate is an exit, the toll gate ID of the toll gate is recorded at an exit ID field in usage history database 112, and the date and time of toll gate passage is recorded at the appropriate field in usage history database 112 (step A5). Finally, CPU 104 transmits a toll gate passage signal including usage information (user ID, entrance ID, exit ID, and date and time of toll gate passage) and a requirement for notifying toll charge information to mobile communication terminal 200 via communication interface 120 (step A6).

Mobile communication terminal 200 transmits to charge server 400 the toll gate passage signal received from car navigation device 100. Charge server 400 performs an operation which will be described later, and transmits toll charge information to mobile communication terminal 200. Mobile communication terminal 200 transmits to car navigation device 100 the toll charge information received from charge server 400. CPU 104 of car navigation device 100 stores the toll charge information received from mobile communication terminal 200, into usage database 112, and displays the charge information on display 160.

<1-3. Configuration of Charge Server>

Charge server 400 has a similar configuration to that of a standard server apparatus. As shown in FIG. 1, Charge server 400 has tariff database 410 and charge database 411.

As shown in FIG. 6, tariff database 410 stores toll charges, each of which corresponds to an entrance and an exit. Tariff database 410 is used in the toll charge search process. As shown in FIG. 7, charge database 411 stores sets of toll charge information. A set of toll charge information includes a user ID, an entrance ID, a name of the entrance toll gate, an exit ID, a name of the exit toll gate, date and time of toll gate passage, toll charge, and information on the balance in a prepaid account.

<2. Operation>

Figure 8:
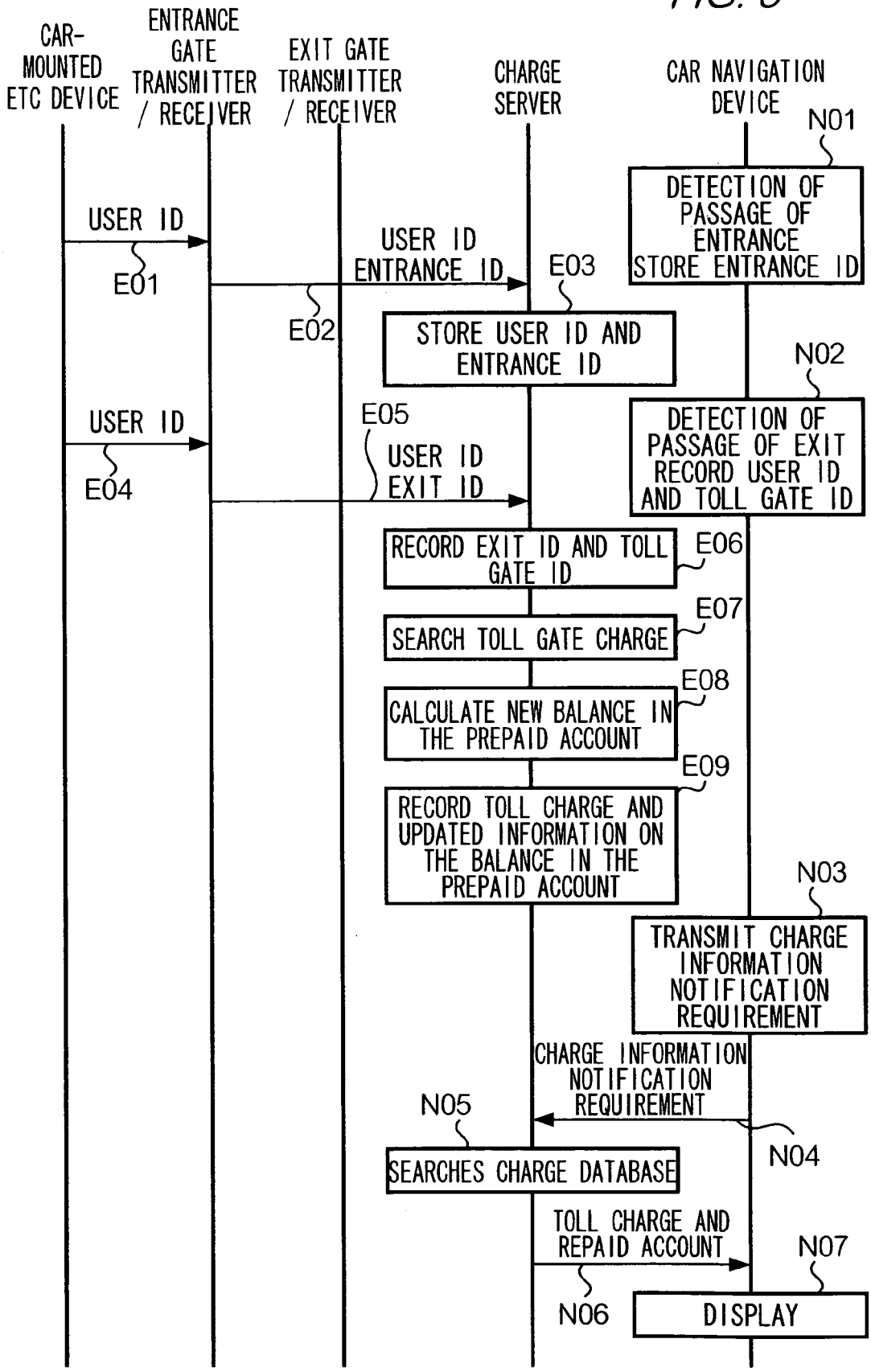
FIG. 8 illustrates the operation of the system in accordance with the embodiment.

The operation of the system in accordance with one preferred embodiment will be described in this section. FIG. 8 illustrates the operation of the system in accordance with the embodiment. In this section, the operation of the system is described in two parts. One describes the procedure of the ETC side and the other describes the procedure of the car navigation side. The term "ETC side" refers to a system comprising car-mounted ETC device 600, gate transmitter/receiver 500, and charge server 400. The term "car navigation side" refers to a system comprising car navigation device 100, mobile communication terminal 200, mobile packet communication network 300, and charge server 400. It is noted that the operation of the ETC side and the operation of the car navigation side are not associated with each other.

First, the operation of the ETC side will be described. When a vehicle passes an entrance toll gate, gate transmitter/receiver 500 receives a customer's user ID from car-mounted ETC device 600 (step E01). The received user ID and the toll gate ID of the entrance toll gate are transmitted from gate transmitter/receiver 500 to charge server 400 (step E02). The user ID and the toll gate ID are recorded in charge database 411 (step E03). The toll gate ID is recorded at an entrance field in charge database 411.

When the vehicle passes an exit toll gate, gate transmitter/receiver 500 receives the user ID from car-mounted ETC device 600 (step E04). The received user ID and the toll gate ID of the exit toll gate are transmitted from gate transmitter/receiver 500 to charge server 400 (step E05). The user ID and the toll gate ID are recorded in charge database 411 (step E06).

Then, charge server 400 searches the charge corresponding to the entrance ID and the exit ID, by referring to tariff database 410 (step E07). Charge server 400 calculates the new balance in the prepaid account after subtracting the toll charge from the prepaid account. (step E08). The toll charge and the updated information on the balance in the prepaid account are recorded in charge database 411 (step E09).

Next, the operation of the car navigation side will be described. When car navigation device 100 is turned on, CPU 104 initiates a toll gate passage detection program and performs an operation shown in a flowchart in FIG. 5. When it is detected that the vehicle has passed an entrance toll gate, the toll gate ID of the entrance toll gate is recorded at an entrance field in usage history database 112 (step N01).

When it is detected that the vehicle has passed an exit toll gate, the toll gate ID of the exit toll gate is recorded at an exit field in usage history database 112. Also, the date and time of the toll gate passage is recorded in usage history database 112 (step N02).

Car navigation device 100 transmits a toll gate passage signal including a set of usage information (user ID, entrance ID, exit ID, and date and time of a toll gate passage)

and a charge information notification requirement, to mobile communication terminal 200 (step N03). The usage information and the charge information notification requirement are transmitted from mobile communication terminal 200 to charge server 400 via mobile packet communication network 300 (step N04).

When charge server 400 receives a signal indicating the passing of a toll gate, charge server 400 searches charge database 411 for charge information corresponding to a passage signal which includes a user ID, an entrance ID, an exit ID, and date and time of toll gate passage, which are congruent with the usage information (step N05). Charge server 400 generates from charge information an e-mail message, which includes the name of entrance toll gate, the name of exit toll gate, toll charge for passing a toll gate, and information on balance remaining in a prepaid account. Then, charge server 400 transmits the e-mail message (hereinafter referred to as "charge information notification mail") to mobile communication terminal 200. Mobile communication terminal 200 transmits the received charge information notification mail to car navigation device 100. Car navigation device 100 displays the contents of the charge information notification mail on display 160.

According to the operation described above, a customer can confirm the charge information immediately after passing the toll gate without operating a device, independent of the connection between the car-mounted ETC device and the car navigation device. Further, according to the embodiment described above, a customer can obtain appropriate toll charge information even if a plurality of customers pass the same exit toll gate at the same time, because the user ID is used for searching toll charge information. Additionally, a customer can obtain appropriate charge information even if a plurality of customers having the same user ID pass different exits at the same time, because an entrance ID is used for searching toll charge information. Additionally, it is not necessary to make a drastic modification to a car navigation device used for the present embodiment, because the passing of an entrance or exit toll gate is detected on the basis of the variations in the positional relations between the vehicle and the entrance/exit toll gate.

<3. Modifications>

Different modifications can be applied to the above embodiment. Following are examples of the modifications.

<3-1. First Modification>

Figure 9:
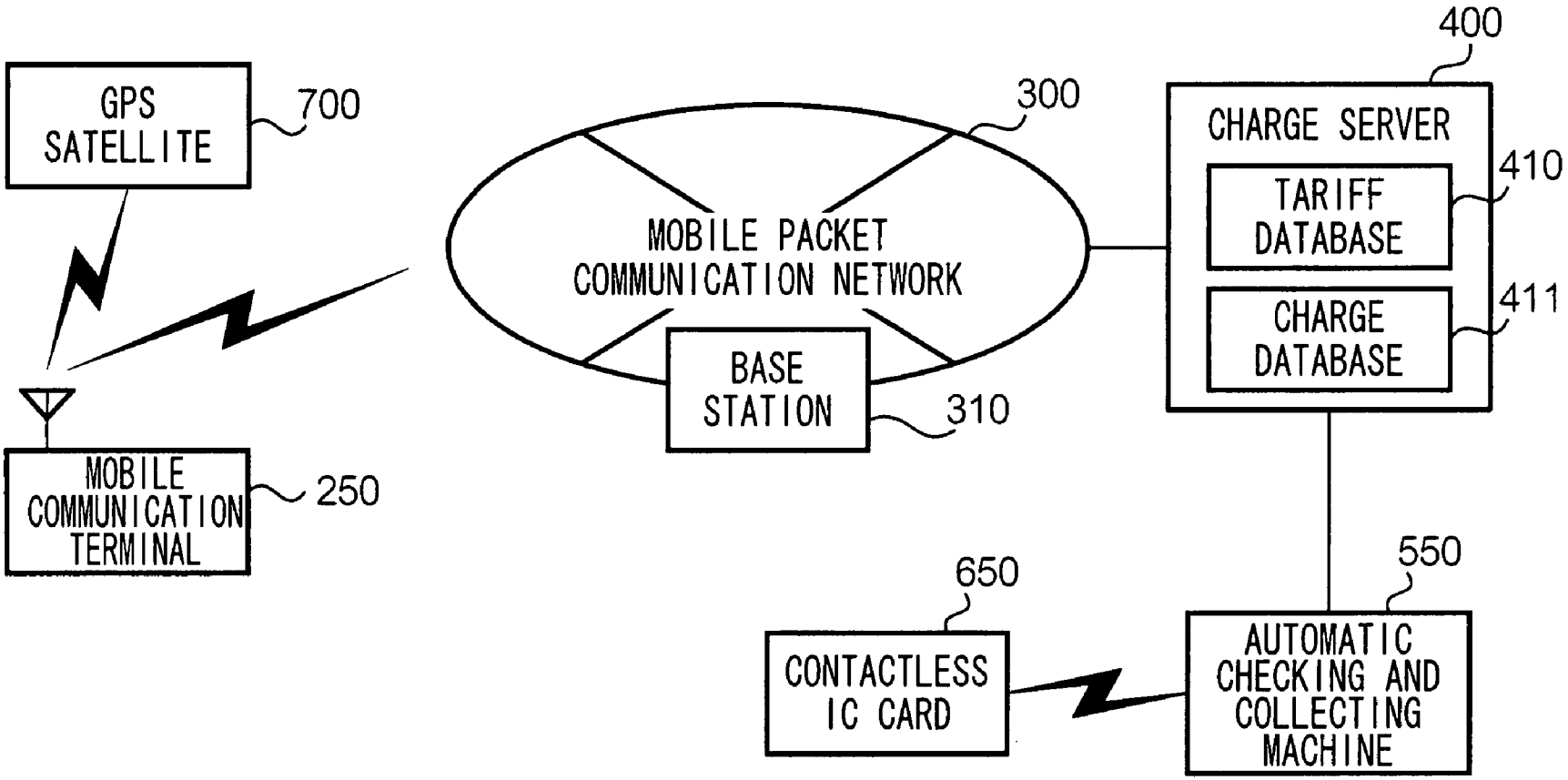
FIG. 9 is a block diagram showing the configuration of a system of another embodiment in accordance with the present invention.

FIG. 9 is a block diagram showing the configuration of a system of the first modification in accordance with the present invention. In this modification, the same elements as those shown in FIG. 1 having the same reference numerals, described above will be referred. As shown in FIG. 9, the system comprises car navigation device 100, mobile communication terminal 250, wireless base station 310, mobile packet communication network 300, charge server 400, automatic checking and collecting machine 550, contactless IC card 650, and GPS satellite 700. Car navigation device 100 and mobile communication terminal 250 may be integrated into a single housing. In the present modification, car navigation 100 comprises, for example, an accelerometer instead of vehicle speed pulse receiver 152 described in the above embodiment. Car navigation device 100 calculates the speed of the vehicle on the basis of the acceleration measured by the accelerometer. Automatic checking and collecting machine 550 is an apparatus having functions for performing wireless communication with contactless IC card 650 and for transmitting/receiving charge information with contactless IC card 650.

Automatic checking and collecting machine 550 performs the operation of gate transmitter/receiver 500 shown in FIG. 1. Contactless IC card 650 functions in the same way as car-mounted ETC device 600 shown in FIG. 1. The operation and the effect of the present modification are the same as those of the system described in the above embodiment.

<3-2. Second Modification>

In a case that a toll charge is fixed, the toll gate passage signal including a user ID and a toll charge information notification requirement may be transmitted to the charge server when the vehicle passes an entrance toll gate.

<3-3. Third Modification>

In a case that a toll charge depends on the entrance toll gate that the vehicle has passed and does not depend on the exit toll gate, the toll gate passage signal including a user ID, an entrance ID, and a toll charge information notification requirement may be transmitted to the charge server when the vehicle passes an entrance toll gate.

<3-4. Fourth Modification>

In a case that a toll charge depends on the exit toll gate that the vehicle has passed and does not depend on the entrance toll gate, the toll gate passage signal including a user ID, an exit ID, and a toll charge information notification requirement may be transmitted to the charge server when the vehicle passes an exit toll gate.

<3-5. Fifth Modification>

In a case that the time interval in payments of a plurality of customers who have the same user ID is sufficiently longer than the time necessary for confirming the balance remaining in the prepaid account, a toll gate passage signal including a user ID and a toll charge information notification requirement may be transmitted to the charge server.

<3-6. Sixth Modification>

In a case that the time interval in payments of a plurality of customers at the same toll gate is sufficiently longer than the time necessary for confirming information on the balance in the prepaid account, a toll gate passage signal including a toll gate ID and a toll charge information notification requirement may be transmitted to the charge server.

<3-7. Seventh Modification>

In a case that (a) the time interval in payments of a plurality of customers who have the same user ID is sufficiently longer than the time necessary for confirming the balance remaining in the prepaid account, and (b) the time interval in payments of a plurality of customers at the same toll gate is sufficiently longer than the time necessary for confirming the balance remaining in a prepaid account, a toll gate passage signal including a toll charge information notification requirement may be transmitted to the charge server.

<3-8. Eighth Modification>

A passage detection method for a vehicle moving in a certain direction and not in the opposite direction may be as follows. Namely, it may be determined that the vehicle passes a toll gate when the distance between a fixed point (e.g., two meters away from the toll gate in the direction of movement) and the vehicle falls to a predetermined distance (e.g., one meter) or less.

<3-9. Ninth Modification>

The system may be applied to an automatic billing system in which a customer pays for a product (or a service) at a store by a prepaid card. In this case, a cash register at the store is substituted for a toll gate.

<3-10. Tenth Modification>

The location of the vehicle may be measured by using location measurement function of a mobile communication terminal. The mobile station can measure its own location by receiving information including the present location information from a mobile communication network such as mobile telecommunication network, personal handy phone network, or wireless local area network system.

<3-11. Eleventh Modification>

The search of the location of a toll gate may be narrowed on the basis of map data, the present location of the vehicle, and the location of a toll gate on the toll road on which the vehicle is running. In this modification, the passing of a toll gate can be detected more efficiently because the search of the toll gate location is narrowed.

<3-12. Twelfth Modification>

The toll gate passage detection program may be downloaded from a server apparatus to a mobile communication terminal and then transmitted to the car navigation device instead of storing the toll gate passage detection program in the car navigation device in advance. According to this modification, the present system can be easily made available as a new toll collection system. Additionally, Java runtime environment may be mounted on the car navigation device for executing a gate passage detection program written in Java programming language. Because mobile communication terminals which can download an application program written in Java programming language is in widespread use, a car navigation device with Java runtime environment would enable a customer to use more applications, compared with a car navigation device which does not use Java runtime environment.

<4. Effect of the Invention>

According to the present invention, the passing of a toll gate by a vehicle can be detected only by a location identification device, and a mobile communication terminal accesses from a toll collection system latest information on the balance remaining in the prepaid account of the customer. Therefore, a customer can confirm the balance in the prepaid account, after passing a toll gate despite the two terminal devices belonging to two separate entities, namely; (a) a terminal device which is an entity of the toll collection system and mounted on a vehicle, and (b) a terminal device which is not an entity of the toll collection system (a location identification device or a mobile communication terminal).

The invention claimed is:

1. A system for notifying charge information, comprising:

a user identification device that stores a user identifier of a customer, the user identification device being mountable on a vehicle;

a gate transmitter/receiver capable of wireless communication with the user identification device;

a charge apparatus configured to store information on a balance in a prepaid account of the customer or the vehicle, and configured to subtract a toll charge from the balance in the prepaid account on the basis of information transmitted from the gate transmitter/receiver;

a mobile communication device configured to communicate with the charge apparatus; and a navigation device capable of communication with the mobile communication device, the navigation device being mountable on the vehicle;

wherein the navigation device comprises:

a memory configured to store map information, the map information including locations of toll gates;

a passage detector configured to detect that the vehicle passes one of the toll gates on the basis of a toll gate passage detection rule, the toll gate passage detection rule including a relation between the vehicle and the one of the toll gates; and a passage signal transmitter configured to transmit a toll gate passage signal to the mobile communication device when the passage detector detects that the vehicle passes one of the toll gates;

the mobile communication device comprises a request transmitter that is configured to transmit to the charge apparatus a request to transmit information including the balance in the prepaid account; and the navigation device comprises notifying means for notifying the customer of the information including the balance in the prepaid account.

2. A system for notifying charge information according to claim 1, wherein the charge apparatus is configured to store information on the balance in the prepaid account corresponding to an identifier of the customer or an identifier of the vehicle; and the mobile communication terminal is configured to transmit to the charge apparatus the identifier of the vehicle or the identifier of the customer when the mobile communication terminal accesses from the charge apparatus latest information on the balance in the prepaid account.

3. A system for notifying charge information according to claim 1, wherein:

the charge apparatus is configured to store information on the balance in the prepaid account corresponding to an identifier of the one of the toll gates;

the memory is further configured to store the identifier of the one of the toll gates;

the passage signal transmitter is configured to transmit the toll gate passage signal including the identifier of the one of the toll gates passed by the vehicle; and the request transmitter is configured to transmit the toll gate passage signal including the identifier of the one of the toll gates.

4. A system for notifying toll charge information according to claim 1, wherein the toll gate passage detection rule is useable to determine that the vehicle has passed the toll gate on the basis of a variation in the location relation of the vehicle and the toll gate.

5. A system for notifying toll charge information according to claim 1, wherein the toll gate passage detection rule is useable to determine that the vehicle has passed a toll gate when a distance between the toll gate and the vehicle falls below a predetermined value and subsequently exceeds the predetermined value.

6. A system for notifying toll charge information according to claim 1, wherein:

the toll gates are a plurality of toll gates of a toll road;

the memory is configured to store map data representative of a road map; the navigation device is configured to identify a first toll gate that the vehicle passes on the basis of the map data, the location of the vehicle, and the location of the first toll gate; and the passage detector is configured to detect that the vehicle passes the first toll gate identified by the navigation device.

7. A car navigation device, comprising:

a memory configured to store map data representative of road maps that include locations of toll gates;

a passage detector configured to detect that a vehicle has passed a toll gate on the basis of a toll gate passage detection rule, the toll gate passage detection rule including a relation between the vehicle and the toll gate;

a signal generator configured to generate a toll gate passage signal when the passage detector detects that the vehicle has passed the toll gate, the toll gate passage signal indicative that the vehicle has passed the toll gate;

a passage signal transmitter configured to transmit the toll gate passage signal to a mobile communication device, wherein the toll gate passage signal includes a request for charge information; and notifying means for notifying a customer of a charge information notification message received in response to the toll gate passage signal, wherein the charge notification message includes the balance in the prepaid account of the customer, a toll charge for passing the toll gate, a user ID, and a toll gate ID.

8. A car navigation device according to claim 7, wherein the toll gate passage detection rule is useable to determine that the vehicle has passed the toll gate on the basis of a variation history in the location relation of the vehicle and the toll gate.

9. A system for notifying charge information, comprising:

a user identification device operable by a user in a vehicle to provide a user ID and a toll ID when the user identification device is in proximity to a toll gate;

a charge server that is outside of the vehicle and is in wireless communication with the user identification device, wherein the charge server is configured to store a balance that is associated with one of the user or the vehicle, and wherein the charge server is configured to receive a signal indicative of the user ID and the toll gate ID, deduct a toll charge from the balance and generate a new balance; and a navigation device operable in the vehicle to be in separate and independent wireless communication with the charge server, wherein the navigation device is configured to separately and independently transmit a toll gate passage signal to the charge server in response to proximity with the toll gate, and in response to the toll gate passage signal, the charge server is configured to transmit a charge information notification signal indicative of the new balance and the deducted toll charge to the navigation device for display thereon.

10. The system of claim 9, wherein the user identification device and the navigation device are operable without any form of communication therebetween.

11. The system of claim 9, wherein the user identification device comprises an electronic toll collection system.

12. The system of claim 9, wherein the toll gate passage signal comprises a set of usage information that includes the user ID and the toll gate ID, and a charge information notification request.

13. The system of claim 9, wherein the charge information notification signal is an email message.

14. The system of claim 13, wherein the email message further comprises a name of an entrance toll gate and a name of an exit toll gate.

15. The system of claim 9, wherein the charge server comprises a tariff database configured to store toll charge information for each of a plurality of toll gates and a tariff database configured to store sets of toll charge information for each of a plurality of users or vehicles.

16. The system of claim 15, wherein one of the sets of toll charge information comprises information received from the user identification device.

17. The system of claim 15, wherein the one of the sets of toll charge information comprises the user ID, the toll gate ID, a name of the toll gate, a date and a time of toll gate passage, and a toll charge.

18. The system of claim 9, wherein the navigation device comprises a memory configured to store a map information database, a toll gate database of toll roads and a usage history database.

19. The system of claim 18, wherein the usage history database is configured to store the toll charge and the new balance to be received from the charge server and the toll gate ID, and a date and time of toll gate passage to be detected by the navigation device.

20. The system of claim 9, wherein the navigation system is configured to automatically display the new balance and the deducted toll charge on a display in response to receipt of the charge information notification signal.

21. The system of claim 9, further comprising a gate transmitter/receiver configured to communicate with the user identification device and the charge server and a mobile communication terminal configured to communicate with the navigation device and the charge server, wherein the gate transmitter/receiver is configured to enable communication between only the user identification device and the charge server, and the mobile communication terminal is configured to provide communication between the navigation device and the charge server.

* * * * *